US005109989A

United States Patent [19]

Kremmin et al.

[11] Patent Number: 5,109,989

[45] Date of Patent: May 5, 1992

[54] ROTARY DISPLAY

[75] Inventors: Klaus Kremmin, Churchville; Thomas R. F. Kremmin, Spencerport, both of N.Y.

[73] Assignee: K-2 Industries, Inc., Pavilion, N.Y.

[21] Appl. No.: 625,882

[22] Filed: Dec. 11, 1990

[51] Int. Cl.[5] ..... A47F 5/00

[52] U.S. Cl. ..... 211/1.55; 108/20; 211/163; 312/252

[58] Field of Search ..... 211/1.5, 163; 312/252; 108/20, 103; 40/505, 501, 430

[56] References Cited

U.S. PATENT DOCUMENTS 4,461,106 7/1984 Lawson ..... 40/430 X 5,024,168 6/1991 Stravitz ..... 108/20 X

*Primary Examiner*—Robert W. Gibson, Jr.

*Attorney, Agent, or Firm*—Eugene Stephens & Associates

[57] ABSTRACT

A solar powered rotary display is assembled on a base having a stationary table mounted on a post fixed to the base, a rotary table mounted for rotation on the base about a main axis defined by the post, and a plurality of display disks mounted for rotation on the rotary table about respective planetary axes carried by the rotary table. A number of drive wheels are mounted on respective axles carried by the rotary table in positions about the main axis for supporting and balancing the rotary table on the base. Each of the drive wheels includes an annular friction surface in contact with both an upper surface of the base and a bottom surface of the display disks for rotating the disks in a fixed ratio with rotation of the rotary table.

28 Claims, 3 Drawing Sheets

ROTARY DISPLAY

BACKGROUND

Sales of a variety of goods ranging from automobiles to fine jewelry have been enhanced by displaying the goods on rotary tables. Motion imparted to the tables attracts attention to the goods and allows them to be viewed from all sides. Attention may be attracted both individually and collectively to a number of goods by rotating the individual goods with respect to each other on separate tables of a display.

For example, U.S. Pat. No. 4,236,769 to Mueller discloses a rotating display stand for foods including a series of shelves that alternately rotate in opposite directions about a vertical axis. Each of the shelves is supported by one of two groups of upstanding rods that carry rollers having slots for receiving annular portions of the shelves. The two groups of rods are rotated in opposite directions by coupling each of the rods to a gear that is driven in series with other gears coupled to adjacent rods. One of the gears in the series is connected to a motor in the base of the display. Rollers carried by the separate groups of rods engage the alternate shelves by friction against an inner portion of the shelves for rotating the shelves in the direction of rotation of rods.

Although Mueller's display stand is appropriate for displaying foods, the vertical stacking of the shelves obscures viewing of the goods from all sides. A variety of goods, especially finely crafted articles, have important features that are not noticeable from a limited angular view. Accordingly, it would be preferable to display collections of such articles by individually mounting the articles on separately rotating tables that do not obscure views of the other tables.

An example of the type of apparatus that could be modified for providing a rotary display of this type is found in U.S. Pat. No. 3,897,063 to Lehwalder. Although Lehwalder's apparatus is actually a game board, a number of game board disks are arranged for a type of motion that is believed to be particularly suitable for displaying articles. A rotatable support plate carries the disks for rotation about respective axes in spaced locations about the plate. Each of the disks is coupled to a planetary gear that meshes with a stationary sun gear centered above the support plate. Angular movement imparted to the support plate transmits a larger angular movement to each of the disks in accordance with the respective tooth numbers of the sun gear and each of the planetary gears.

Nevertheless, Lehwalder's disks are not well supported for carrying articles for display, and the separate gears required to impart motion to the disks make the game board especially expensive and complicated to manufacture for purposes of a similarly sized display. The disks and support plate are mounted on separate bearings that incur frictional losses in addition to frictional losses incurred by the gear meshes that are used to rotate them. Also, Lehwalder does not have any means for automatically rotating the support plate to provide continuous motion to the disks.

SUMMARY OF THE INVENTION

Our invention is an attractive rotary display that is especially appropriate for displaying fine articles. The display is designed for ease of manufacture, low cost, efficient operation, strength, and durability.

The display is assembled on a base having an upper support surface. A rotary table is mounted for rotation on the base about a main axis of rotation. A motor is mounted within the base and is operatively connected with an annular portion of the rotary table for imparting continuous rotation to the table. A plurality of display disks are mounted for rotation on the table about respective planetary axes that are carried by the table. A like number of drive wheels are mounted for rotation about respective drive axes that are also carried by the table. However, the drive axes extend substantially perpendicular to the main and planetary axes, and each of the drive axes substantially intersects the main axis and one of the planetary axes.

The drive wheels include annular rims centered about the respective drive axes. One diametral end of the rims frictionally engages the upper support surface of the base and provides a bearing for supporting the rotary table on the base. The opposite diametral end of the rims frictionally engages a bottom surface of the display disks and provides a bearing for partially supporting the disks on the rotary table. In addition to supporting both the rotary table and the display disks, the frictional engagements of the drive wheels are used to rotate the disks in response to rotation of the table.

Each of the display disks is also partially supported on the table by a pair of idler wheels having respective axes of rotation that are also carried by the rotary table. Similar to the axes of the drive wheels, the axes of the idler wheels are oriented in directions that are substantially perpendicular to the main and planetary axes. However, the idler wheel axes substantially intersect only the planetary axes of the display disks that they are supporting. The two idler wheels of each pair, together with one of the drive wheels, provide three points of support for the respective disks. As respective bearing surfaces, the drive and idler wheels permit tangential rotary motion of the rotary table and display disks but resist any radial motion that might cause the table or disks to move eccentrically.

Each of the drive wheel rims is formed with annular flanges that project from opposite sides of a peripheral groove. A flexible friction band is mounted in the groove and projects radially beyond the two flanges for frictionally engaging both the upper support surface of the table and the bottom surface of the disks. The two flanges have different size diameters so that radial compression of the friction band is limited by only one of the flanges. The amount of radial compression is sufficient to provide traction for driving the respective disks but is limited to prevent a flat spot from forming on the bands when the table is loaded in a stationary position.

The dual function of the drive wheels as both bearing surfaces and traction drive elements provides a highly efficient drive system for rotating the table and disks. This makes possible use of a solar power cell (i.e., photovoltaic cell) for generating electrical current for energizing the drive motor. For example, one version of our rotary display can be rotated by the drive motor drawing less than one ampere at one-half volt generated by a single solar power cell under ordinary display lighting conditions.

The power cell is mounted within a recess formed in a stationary display table that is supported on a post mounted on the base. Twin leads of the power cell extend through the post into the base and are connected to the motor that is mounted within the base. The post also forms the main axis about which the rotary table is rotated. The display table is supported on the post in a spaced relationship with the base to provide clearance within which the rotary table is rotated. However, portions of the rotary table are raised flush with upper surfaces of the display table and the display disks, forming a near continuous surface interrupted only by small clearances that permit relative rotation between the display table, rotary table, and display disks.

Three relative rotations are apparent in a single plane surface of our display. First, the rotary table is rotated relative to the display table. Second, the display disks are rotated relative to the rotary table. Third, the direction that the display disks are rotated is preferably opposite to the direction of rotation of the rotary table so that the relative rotation of the display disks with respect to the display table is reduced by the relative rotation of the rotary table. It is also preferred to rotate the display disks relative to the display table by a noninteger multiple of the angular rotation of the rotary table relative to the display table so that the respective angular positions of the display disks vary with respect to the display table between successive rotations of the rotary table. This relationship helps to assure that all sides of an article displayed on one of the display disks may be viewed from a single perspective, even though the view of the article may be partially obscured during one turn of the rotary table by articles supported on the other display disks.

DRAWINGS

DETAILED DESCRIPTION

Figure 1:
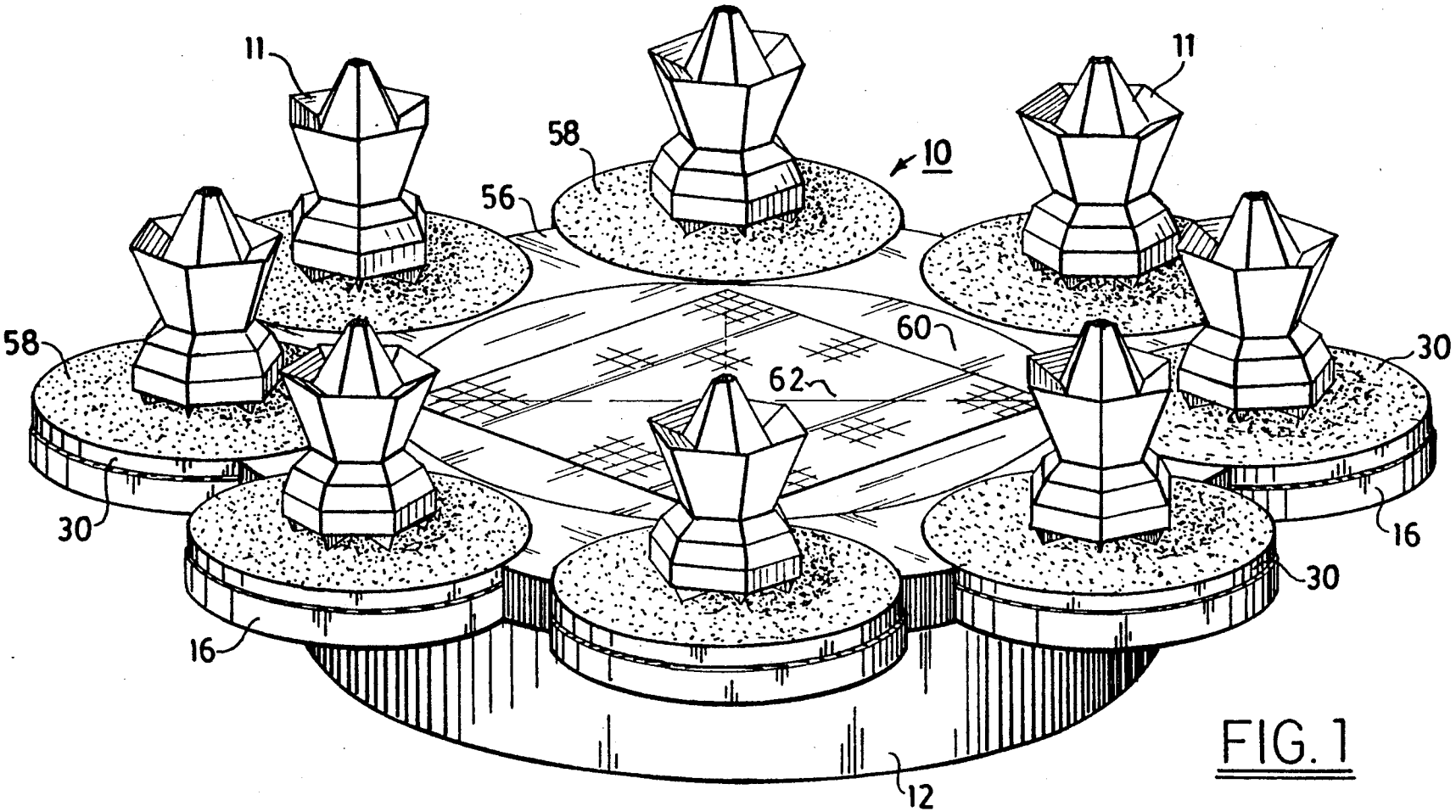
FIG. 1 is a perspective view of our rotary display showing exemplary articles exhibited on disks that are arranged about the periphery of the display.
Figure 2:
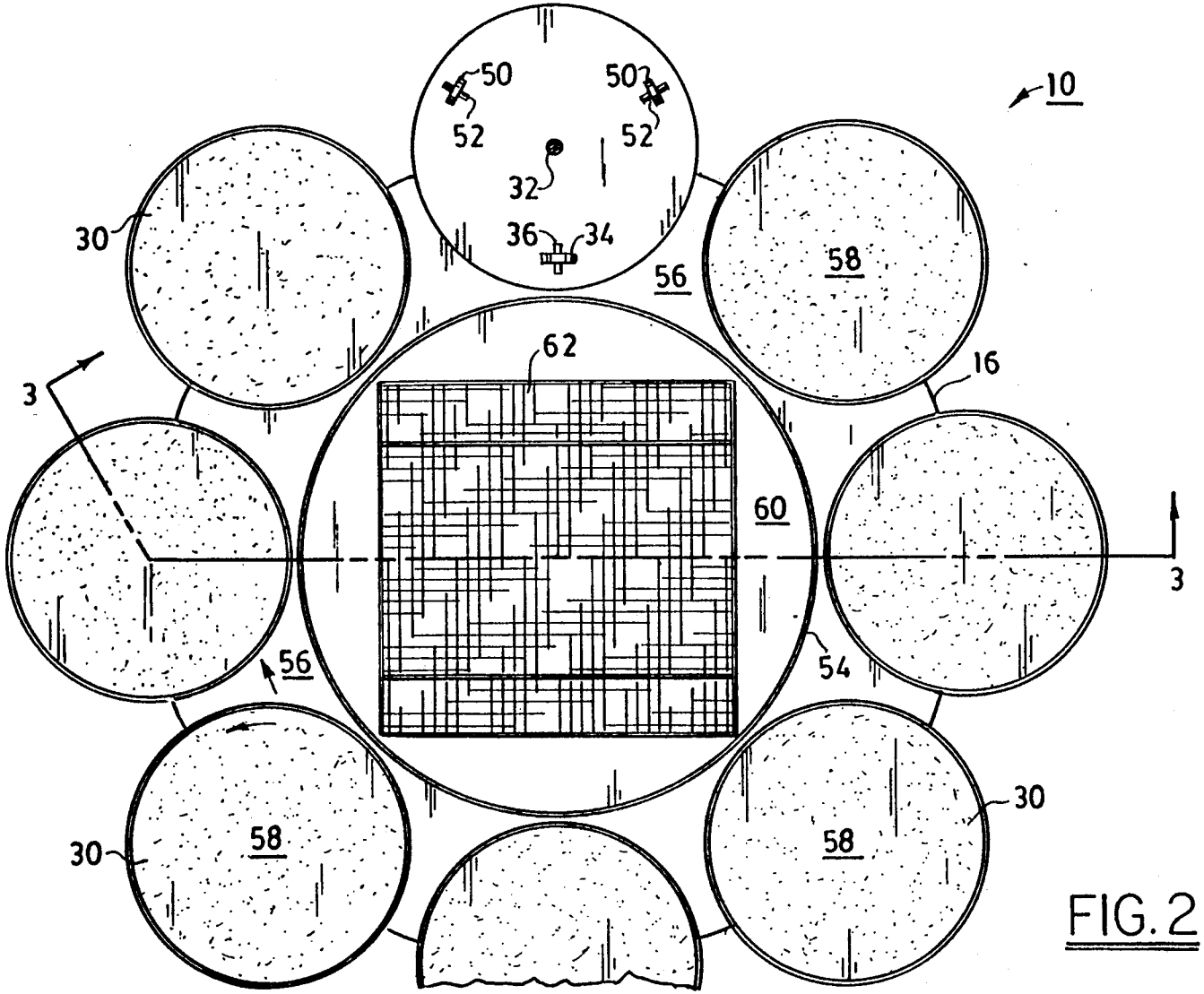
FIG. 2 is a plan view of our display with one of the display disks removed to reveal drive and idler wheels mounted in a rotary table for supporting the disks.
Figure 3:
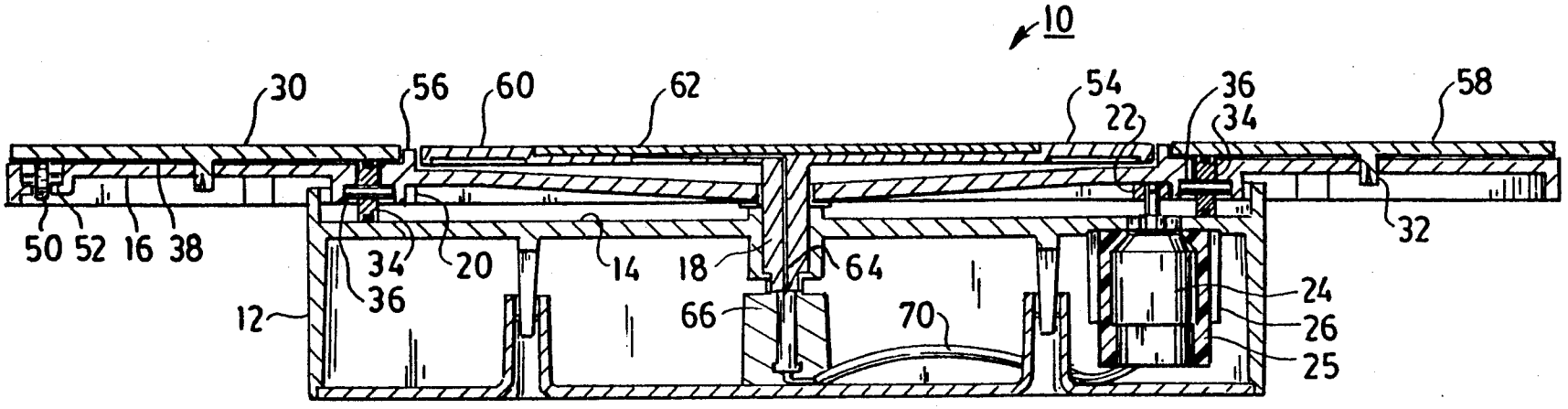
FIG. 3 is a cross-sectional view of the display taken along line 3—3 of FIG. 2.

A preferred embodiment of our invention is illustrated by the four drawing figures The first drawing figure provides a perspective view showing our rotary display 10 exhibiting a number of exemplary fine articles 11. The remaining drawing figures depict details of how the rotary display 10 is constructed.

The rotary display 10 is assembled on a base 12 having an upper support surface 14. A rotary table 16 is supported on the base 12 for rotation about a main axis that takes the form of a post 18 fixed to the base. The rotary table 16 includes an annular portion 20 in the form of an internal ring gear that meshes with a pinion gear 22 keyed to a drive shaft. A motor 24, which rotates the pinion drive shaft, is supported between fingers 26 that project beneath the upper support surface 14 of the base. A grommet 25 is used to mount the motor 24 between the fingers 26 in a conventional manner.

A plurality of display disks 30 are mounted for rotation on the rotary table 16 about planetary axes that take the form of split posts 32, which are snap fit into engagement with respective bores formed in the table 16. Drive wheels 34 are also carried by the table on axes of rotation that take the form of drive axles 36. However, the axes (i.e., drive axles 36) of the drive wheels 34 are oriented substantially perpendicular to the main axis (i.e., post 18) of the rotary table 16 and the planetary axes (i.e., split posts 32) of the display disks 30, and each of the drive wheel axes substantially intersects the main axis and one of the planetary axes.

Each of the drive wheels 34 includes an annular rim that is centered about one of the respective drive axles 36. One diametral end of the rims frictionally engages the upper support surface 14 of the base and provides a bearing surface for supporting and balancing the rotary table 16 on the base. The opposite diametral end of the rims frictionally engages a bottom surface 38 of the display disks and provides a bearing surface for partially supporting the display disks 30 on the rotary table.

Figure 4:
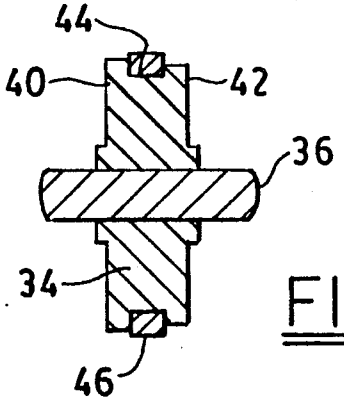
FIG. 4 is a greatly enlarged cross-sectional view of one of the drive wheels.

With particular reference to FIG. 4, it can be seen that the rims of the drive wheels 34 include annular flanges 40 and 42 that project from opposite sides of a peripheral groove 44. A flexible friction band 46, which is made from a compressible material such as silicone, is mounted in the groove 44 and projects a short radial distance beyond the two flanges 40 and 42 for frictionally engaging both the upper support surface 14 of the table and the bottom surface 38 of the display disks.

However, the flange 40 has a diameter that is slightly larger than the diameter of the other flange 42. The larger flange 40 limits an amount that the friction band 46 can compress between the upper support surface 14 of the base and the peripheral groove 44 to prevent a flat spot from forming on the friction band 46 when the rotary table 16 is loaded in place for an extended period of time. Nevertheless, the amount of radial compression permitted by the larger flange 40 is sufficient to provide traction for rotating the drive wheels 34 on the upper support surface 14 of the base and for transmitting rotation of the rotary table to the display disks 30.

The other flange 42 is made with a smaller diameter to prevent more than one flange of each drive wheel from contacting the upper support surface 14 of the base. Since the two flanges 40 and 42 are located at different radial distances from the main axis (i.e., post 18) of the rotary table, the two flanges would be required to rotate at different rates to maintain rolling contact with the upper support surface of the base. Thus, if both flanges were of equal diameter, one or the other of the two flanges would tend to brake against rotation of the rotary table.

Each of the display disks 30 is also partially supported by a pair of idler wheels 50 that are mounted for rotation about respective axes that take the form of axles 52. The idler wheel axles 52 are formed integrally with the idler wheels 50 and are journaled in the rotary table 16. The axes (i.e., axles 52) of each pair of idler wheels 50, together with the axis (i.e., drive axle 36) of one of the drive wheels 34, are located at substantially equal angular spacings about the respective planetary axes (i.e., split posts 32) of the display disks 30 for balancing the display disks on the rotary table. Similar to the axes of the drive wheels, the axes of the idler wheels extend in a plane perpendicular to the main and planetary axes, but the idler wheel axes intersect only the planetary axes of the display disks they are supporting.

The two idler wheels 50 and the one drive wheel 34 that support the display disks 30 on the rotary table 16 provide respective bearing surfaces for permitting tangential rotary motion of the disks, and the same bearing surfaces tend to resist any radial motion that would cause the display disks to rotate eccentrically. In other words, the drive and idler wheels supplement the function of the split posts 32 of the display disks for maintaining the display disks in a desired position on the rotary table 16. However, the drive wheels 34 also provide traction surfaces in the form of flexible friction bands 46 for transmitting tangential rotary motion of the rotary table 16 to the display disks 30. The same traction surfaces also resist any radial motion that would cause the rotary table 16 to move eccentrically about the post 18. This helps to reduce wear between the stationary post 18 and the rotary table.

A stationary display table 54 is mounted on an end of the post 18 in a spaced relationship with the upper support surface 14 of the base to provide clearance within which the rotary table 16 is rotated. However, portions 56 of the rotary table 16 are raised flush with upper surfaces 58 of the display disks 30 and upper surface 60 of the display table 54. The raised portions 56 of the rotary table, together with the respective upper surfaces 58 and 60 of the display disks and the display table, define a near continuous surface interrupted only by small clearances that permit relative rotation between the display table, rotary table, and the display disks.

The drive wheels 34 divide a distance between the main axis (i.e., post 18) and each of the planetary axes (i.e., split posts 32) into two portions. The display disks 30 are rotated with respect to the rotary table 16 in inverse proportion to the distance between the drive wheels and the the planetary axes divided by the distance between the drive wheels and the main axis. However, the rotary table rotates with respect to the display table 54 in a direction opposite to the direction of rotation of the display disks with respect to the rotary table. Since the rotary table also rotates the display disks about the main axis of the display, the angular rotation of the display disks with respect to the display table is reduced by the angular rotation of the rotary table with respect to the display table. Preferably, the display disks rotate with respect to the display table by a noninteger multiple of the rotations of the rotary table so that the respective display disks are oriented at different angular positions with respect to the display table between successive rotations of the rotary table.

The depicted display is powered by a conventional photovoltaic power cell 62 mounted within a recess formed in the stationary display table 54. The power cell 62 is protected by a layer of glass that is mounted against the power cell flush with the upper surface 60 of the display table. A pair of leads 64 extend through the post 18 into contact with a connector 66 in the base 12. Wires 70 complete a connection of the power cell 62 with terminals of the motor 24 in a conventional manner. The motor 24 is energized by a DC current produced by the power cell in response to the exposure of the cell to lighting typical of displays. Preferably, the display is lit by a quartz halogen light to which conventional photovoltaic power cells are most responsive. This light is also preferable for displaying articles, since the light includes a wide range of spectrums that help to reflect the full colors of the articles displayed.

Since the power cell 62 requires light to generate electrical current, our display is rotated only when the power cell is exposed to light. In other words, the display may be turned on and off with a switch that controls lighting for the display. The speed at which the display is rotated may also be controlled by varying the intensity of light given off by a lighting source or by varying the distance between the lighting source and the display. It would also be possible to increase the amount of electrical power for rotating a given size display by arranging more than one power cell to project above the display in the form of a pyramid or other shape for gathering light over a larger area.

Although our display is preferably powered by a photovoltaic cell, other sources of electrical power may also be used. For example, the electrical power could be supplied from rechargeable batteries stored in the base or from a conventional electrical outlet wired to the display. Of course, if the photovoltaic power cell is not used, a switch would be needed to turn the display on and off.

A variety of coverings may be used to enhance the appearance of the display disks, rotary table, and display table. For example, the entire upper surface of the display may be covered by a velvet fabric material. The disks may be made from the same color material as the rest of the display or from different colors that may be used to accent the display or to promote a seasonal theme for the display. Holographic materials may also be used to better reflect light from the display disks to enhance the appearance of the articles on display.

Most of the major components of the display including the base 12, the rotary table 16, the display disks 30, and the display table 54 have been designed to be readily manufactured by conventional injection molding processes. The display disks may also be injection molded against the covering material to provide a permanent bond between the disks and the covering material. Replacement display disks, bonded to a variety of different covering materials, may be made available with the display for changing the display's appearance. The replacement disks may be readily substituted for the display disks already mounted in the display by unsnapping the split posts 32 of the mounted disks from their respective bores in the rotary table and by snapping split posts of the replacement disks into the same bores in the rotary table.

We claim:

1. A rotary display comprising:

a base having an upper support surface;

a rotary table mounted for rotation on said base about a main axis of rotation;

means for rotating said rotary table including a drive mechanism that projects through said support surface of the base into engagement with an annular portion of said rotary table;

a plurality of display disks mounted for rotation about respective planetary axes of rotation carried by said rotary table;

a plurality of drive wheels mounted for rotation about respective drive axes of rotation carried by said rotary table; each of said drive axes extends substantially perpendicular to said main and planetary axes and substantially intersects said main axis and one of said planetary axes; and each of said drive wheels includes an annular rim journaled about one of said drive axes; one diametral end of said annular rim is frictionally engaged with said upper support surface of the base, and the other diametral end of said annular rim is frictionally engaged with a bottom surface of said display disks whereby each of said display disks is rotated in response to rotation of said rotary table.

2. The rotary display of claim 1 in which said one diametral end of the annular rim also provides a bearing surface for supporting said rotary table on said upper support surface of the base

3. The rotary display of claim 2 in which said other diametral end of the annular rim also provides a bearing surface for supporting said bottom surface of the display disks on said rotary table.

4. The rotary display of claim 3 in which said bearing surface at the one end of the annular rim of each of the drive wheels permits tangential rotary motion of said rotary table on said upper support surface of the base and resists radial motion that would cause the rotary table to move eccentrically about said main axis.

5. The rotary display of claim 1 in which each of said annular rims includes a peripheral groove that is formed between two annular flanges and a flexible friction band that is mounted in said groove and projects radially of said annular rim beyond both of said annular flanges.

6. The rotary display of claim 5 in which said annular flanges on opposite sides of said grooves are further defined by respective diameters; one of said flange diameters is larger than the other of said flange diameters so that radial compression of said flexible friction band between said upper support surface of the base and said bottom surface of each of said display disks is limited by only one of said respective flanges.

7. The rotary display of claim 6 in which the compression of the flexible friction band is limited to prevent a flat spot from forming on said band when said rotary table is loaded in a stationary position.

8. The rotary display of claim 1 in which said main axis about which the rotary table rotates is defined by a post that is fixed against rotation with respect to said base.

9. The rotary display of claim 8 further comprising a stationary display table supported on said post in a spaced relationship with said base for providing clearance within which said rotary table is rotated.

10. The rotary display of claim 9 further comprising a photovoltaic power cell mounted within a recess formed in a top surface of said stationary display table.

11. The rotary display of claim 10 in which leads of the power cell extend through said post into said base.

12. The rotary display of claim 11 in which said leads are connected to a motor mounted in said base for supplying electrical power to said motor.

13. The rotary display of claim 12 in which said motor rotates a pinion gear that is engaged with an internal ring gear formed in said annular portion of the rotary table for rotating said rotary table.

14. The rotary display of claim 9 in which said rotary table is rotatable in a first direction with respect to said stationary table, said display disks are rotatable in a second direction with respect to said rotary table, and rotation of said display disks with respect to said display table is reduced by rotation of said rotary table with respect to said display table.

15. The rotary display of claim 14 in which said display disks are rotatable relative to said display table by a noninteger multiple of angular rotation of the rotary table relative to the display table so that respective angular positions of said display disks relative to said display table varies between successive rotations of said rotary table relative to said display table.

16. The rotary display of claim 15 in which said display disks are rotatable relative to said rotary table in a fixed ratio with the rotation of said rotary table relative to said display table, and said fixed ratio is in inverse proportion to a first distance between said drive wheels and said planetary axes of the display disks divided by a second distance between said drive wheels and said main axis of the rotary table.

17. A rotary display comprising:

a base having an upper support surface;

a stationary display table mounted on a post projecting from said upper support surface of said base;

a rotary table also having an upper support surface and being mounted for rotation about said post between said base and said stationary display table;

drive wheels mounted on respective axles carried by said rotary table and arranged about a periphery of said base for supporting and balancing said rotary table for rotation on said upper support surface of the base;

means for rotating said rotary table about said post on said upper support surface of the base;

a plurality of display disks located about a periphery of said stationary display table and mounted for rotation about respective axes carried by said rotary table;

a plurality of idler wheels mounted for rotation about axes also carried by said rotary table and arranged in pairs for partly supporting and balancing each of said display disks on said upper support surface of the rotary table;

said drive wheels extend through said upper support surface of the rotary table for further supporting and balancing each of said display disks on said upper support surface of said base; and each of said drive wheels includes an annular friction surface in contact with both a bottom surface of one of said display disks and said upper support surface of the base for rotating said display disks about their respective axes in response to rotation of said rotary table about said post.

18. The rotary display of claim 17 in which a portion of said upper support surface of the rotary table is raised flush with respective upper surfaces of said stationary display table and said display disks, forming a near continuous surface interrupted only by small clearances for permitting relative rotation between said stationary display table, said rotary table, and said display disks.

19. The rotary display of claim 18 in which said rotating means includes a solar power cell embedded in said stationary display table and covered by a glazing that is mounted flush with said upper surface of the stationary table.

20. The rotary display of claim 19 in which leads of said solar power cell extend through said post into said base and are connected to a motor mounted within said base.

21. The rotary display of claim 20 in which said motor is operatively connected to a pinion and ring gear for rotating said rotary table.

22. The rotary display of claim 21 in which each of said axles of the drive gears is located between said post and one of said axes of the display disks for rotating said rotary table and said display disks in opposite directions.

23. A solar powered rotary display comprising:

a base having an upper support surface;

a stationary display table mounted on a post projecting from said upper support surface of said base;

a rotary table also having an upper support surface and being mounted for rotation about said post between said base and said stationary display table;

drive wheels mounted on respective axles carried by said rotary table and arranged about a periphery of said base for supporting and balancing said rotary table for rotation on said upper support surface of the base;

a solar power cell embedded in said stationary display table and covered by a glazing;

a pair of leads from said solar power cell extending through said post into said base;

an electric motor connected to said leads and sized to be powered by said solar power cell;

a drive mechanism operatively connected to said motor projecting through said upper support surface of the base into engagement with an annular portion of said rotary table for rotating said rotary table about said post on said upper support surface of the base;

a plurality of display disks located about a periphery of said stationary display table and mounted for rotation about respective planetary axes carried by said rotary table;

a plurality of idler wheels mounted for rotation about axes also carried by said rotary table and arranged in pairs for partly supporting and balancing each of said display disks on said upper support surface of the rotary table;

said drive wheels extend through said upper support surface of the rotary table for further supporting and balancing each of said display disks on said upper support surface of said base;

each of said drive axles extends in a direction substantially perpendicular to said main and planetary axes and intersects said main axis and one of said planetary axes; and each of said drive wheels includes an annular friction surface in contact with both a bottom surface of one of said display disks and said upper support surface of the base for rotating said display disks about their respective axes in response to rotation of said rotary table about said post.

24. The rotary display of claim 23 in which each of said drive wheels includes a peripheral groove formed between two annular flanges and a flexible friction band mounted on said groove and projecting radially of said annular rim beyond both of said annular flanges.

25. The rotary display of claim 24 in which said annular flanges on opposite sides of said grooves are further defined by respective diameters; one of said flange diameters is larger than the other of said flange diameters so that radial compression of said flexible friction band between said upper support surface of the base and said bottom surface of each of said display disks is limited by only one of said respective flanges.

26. The rotary display of claim 23 in which a portion of said upper support surface of the rotary table is raised flush with respective upper surfaces of said stationary display table and said display disks, forming a near continuous surface interrupted only by small clearances for permitting relative rotation between said stationary display table, said rotary table, and said display disks.

27. The rotary display of claim 26 in which each of said axles of the drive gears is located between said post and one of said axes of the display disks for rotating said rotary table and said display disks in opposite directions.

28. The rotary display of claim 27 in which said drive mechanism includes a pinion gear engaged with an internal ring gear that is formed in said annular portion of the rotary table.

* * * * *